US005226603A

United States Patent [19]

Reichner

[11] Patent Number: 5,226,603

[45] Date of Patent: Jul. 13, 1993

[54] METHOD AND APPARATUS FOR IMPACTION PROCESSING OF ORE BODIES

[76] Inventor: Thomas W. Reichner, 1826 Warriors Rd., Pittsburgh, Pa. 15205

[21] Appl. No.: 881,261

[22] Filed: May 11, 1992

[51] Int. Cl.[5] ..... B02C 19/00

[52] U.S. Cl. ..... 241/5; 241/40; 241/80; 241/275

[58] Field of Search ..... 241/5, 40, 52, 55, 79.1, 241/80, 275

[56] References Cited

U.S. PATENT DOCUMENTS

| | | | |
|---|---|---|---|
| 1,061,142 | 5/1913 | Tesla | 415/90 |
| 1,575,717 | 3/1925 | Plauson | 241/16 |
| 2,512,523 | 6/1950 | Fisher et al. | 241/275 X |
| 2,546,286 | 3/1951 | Zakel | 241/50 |
| 2,823,868 | 2/1958 | Scherer | 241/2 |
| 3,255,793 | 6/1966 | Clute | 241/1 X |
| 3,788,562 | 1/1974 | Greenlay et al. | 241/4 |
| 3,970,257 | 7/1976 | MacDonald et al. | 241/275 |
| 3,979,073 | 9/1976 | Leliaert | 241/5 |
| 3,995,814 | 12/1976 | Alberts | 241/5 |
| 4,133,487 | 1/1979 | Lanier | 241/5 |
| 4,335,994 | 6/1982 | Gurth | 415/90 |
| 4,575,013 | 3/1986 | Bartlem | 241/275 |
| 4,993,647 | 2/1991 | Williams | 241/80 X |
| 5,096,129 | 3/1992 | Gilbert et al. | 241/60 |

FOREIGN PATENT DOCUMENTS 2018456 11/1971 Fed. Rep. of Germany .

*Primary Examiner*—Frank T. Yost
*Assistant Examiner*—Clark F. Dexter
*Attorney, Agent, or Firm*—Armstrong, Westerman, Hattori, McLeland & Naughton

[57] ABSTRACT

The apparatus and its process utilization enables a higher throughput of ore bodies being comminuted, provides a closer or more accurate selection of size of particles or particulates produced, has a low noise level in its operation, and uses its rotor impeller to facilitate the charging-in of ore bodies to be processed, the breaking-up of such bodies, and the delivery of such bodies in the form of sized particles or particulates is introduced by suction peripherally into one of the compartments of a motor-drive impeller and axially into all of the compartments, ore bodies are introduced into all of the compartments and are thrown under centrifugal force from one of the compartments against an anvil. Broken-up bodies of a desired size are fluidized and moved upwardly out of the apparatus while those of a rejected size are returned to the impeller for reprocessing with additional ore bodies being newly introduced therein. The impeller operates in a circular housing that is cushioned and sound-proofed by a suitable resin or plastic backing. The speed of rotation of the motor drive controls the size and size range of the particles or particulates produced. Input of fluidizing air into the apparatus is provided by rotation of the impeller with the entry quantity being valvecontrolled.

11 Claims, 3 Drawing Sheets

METHOD AND APPARATUS FOR IMPACTION PROCESSING OF ORE BODIES

This invention relates to an improved impacting process and apparatus for breaking-up and selectively sizing frangible ore bodies and the like.

A phase of the invention deals with apparatus and procedure in which a dual or two step type of selection is effected as to the particles and particulates that are produced and, in such a manner as to provide a better control of the size range desired.

BACKGROUND OF THE INVENTION

Hereto, for the most part, it has been more or less conventional to feed ore bodies and the like vertically or more or less by gravity directly into an upper open mouth of a comminuting apparatus or machine. I have devised an apparatus wherein an improved through-put may be attained by a dual axial input of the bodies. Also, better size range control or selection may be attained. The construction enables a maximized fluidization in a gaseous stream of the bodies and their fractured or broken-up sized counterparts, a minimization of wear and tear on the apparatus, a highly effective size selection of the resultant particles or particulates, and a suitable control of noise produced during the operation.

OBJECTS OF THE INVENTION

It has been an object of my invention to devise an impact mill or comminuting apparatus that will have an improved efficiency in its operation and through-put.

Another object has been to devise an improved method or approach to the feeding-in, breaking-up, sizing and fluidizing in an air stream of ore bodies and of the resultant particles and particulates, all with a minimization of wear and tear on the apparatus.

A further object has been to devise a comminuting apparatus that employs a dual horizontal or axial in-put of the material to be broken-up, with a centrifugal force generated, radial-outward and upward impaction of the ore bodies in which particles or particulates of a desired size are fluidized, accelerated, selected and fed upwardly out of its housing or enclosure, and bodies of larger size than desired are returned to a rotating impeller or rotor and combined with newly introduced ore bodies for further impaction and selection.

These and other objects of my invention will appear to those skilled in the art from the specification, the abstract and the claims.

SUMMARY OF THE INVENTION

In developing my improved apparatus, machine or device, and the process involved in its utilization, I have found that it is important to maximize through-put, minimize wear and tear as well as noise of operation while, at the same time, to maximize size selectivity. I believe that I have been able to accomplish all of these results by a new approach to the in and out feed, fluidization, and a fluidized impaction breaking-up, initial transverse and then upward feed and selection of particulates of the desired size.

Ore bodies are shown introduced horizontally by an enclosed conveyor into a side chamber of an enclosed container in such a manner as to restrict an inflow with the bodies, then downward along its downwardly converging sides, axially into opposite ends of a hollow, tubular shaft of an impeller or rotor, and internally into one of the three radial compartments of the impeller wherein they are in effect, fluidized by a gaseous flow, such as of air, being drawn under impeller-induced suction therein and then rotatively advanced within the compartments and, under centrifugal force, projected substantially radially upwardly outwardly therefrom the compartment against anvil means to comminute or break them up. Broken-up bodies are then shown under fluidization moved transversely from the anvil means and upwardly within the container while heavier or larger size broken-up portions of the ore bodies are immediately returned to the compartment. Intermediate but undesired sizes of fluidized particles while they are being thrown airborne upwardly towards an outlet with decreasing fluid force, progressively fall backwardly out of the gaseous up-stream, migrate towards and mix with an incoming down-flowing feed stream of newly entering ore bodies and with them are again introduced with such bodies in succession into each compartment of the impeller during its rotation for reprocessing. At the same time, material of a selected desired size, such as particulates, under continued fluidization, are advanced upwardly along the inside of the container and delivered under valve control therefrom. The operation is continued to progressively break-up ore bodies and, under air flotation, progressively remove particulates of a desired selected size from the apparatus. This is done relatively quietly with a minimum of wear and tear on internal surfaces of the apparatus. During its rotative movement, the impeller draws in fluidizing air into one of its compartments while a rotatively advanced compartment is centrifugally projecting ore bodies therein into breaking up impaction with the anvil.

Figure 5:
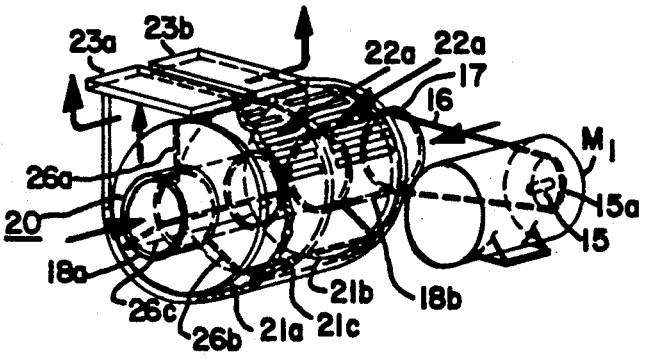
Figure 4:
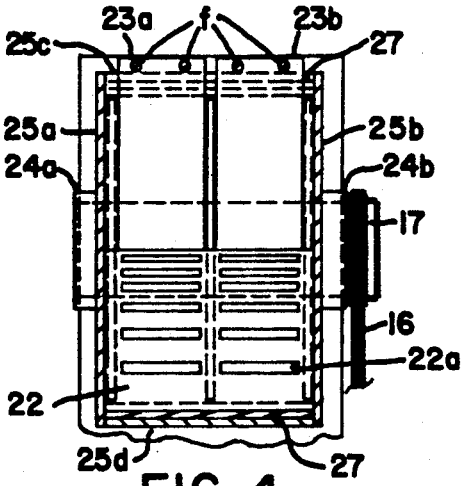
FIG. 4 is a horizontal fragmental section on the scale of and taken along the line IV—IV of FIG. 2.

And, FIG. 5 is a schematic view in elevation of the device of my invention on a greatly reduced scale with respect to FIGS. 1 to 4, inclusive.

DETAILED DESCRIPTION OF THE DRAWINGS

Figure 1:
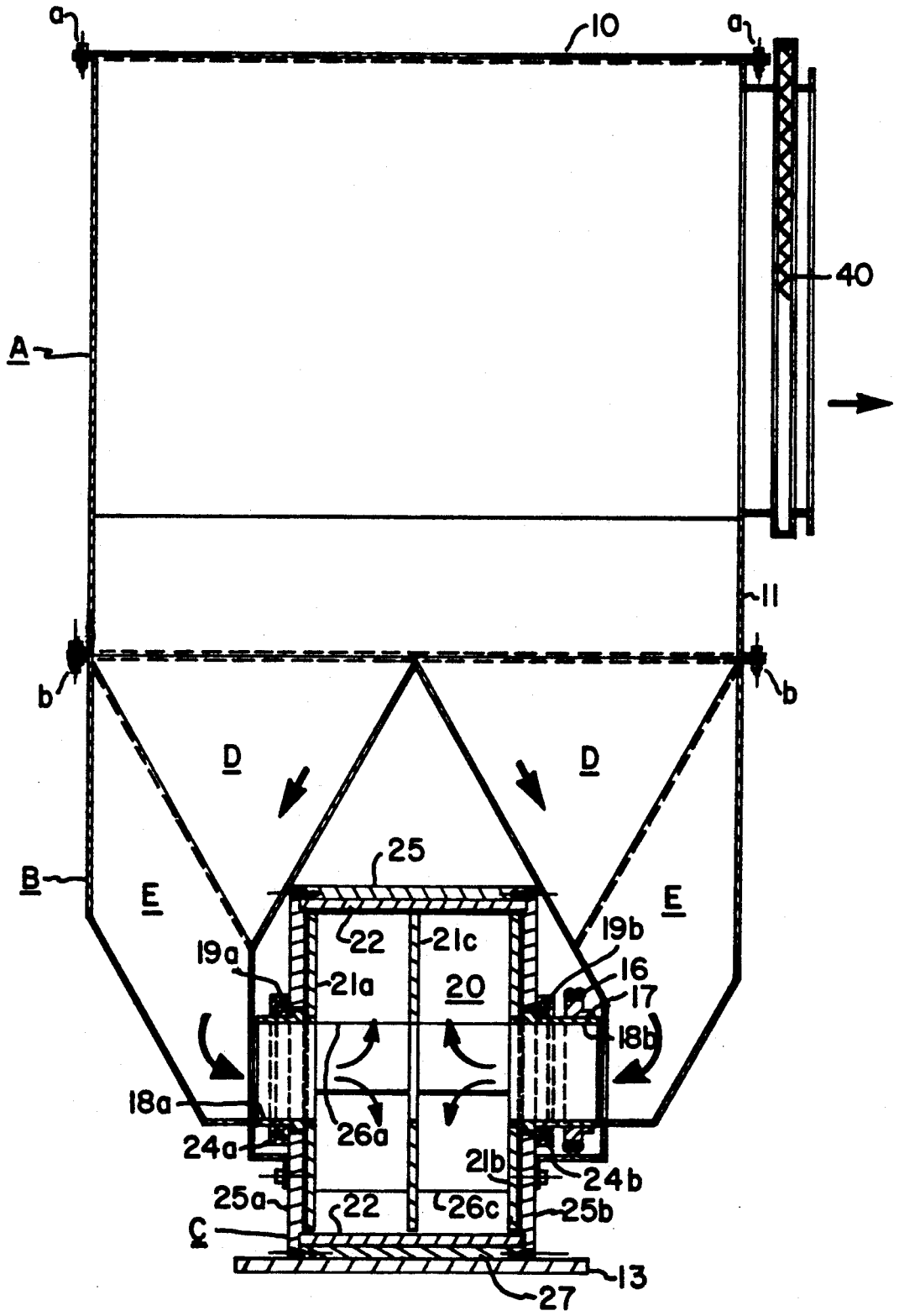
FIG. 1 is a vertical end section in elevation of an upright extending, enclosed apparatus or device constructed in accordance with my invention; it is on the scale of and taken along line I—I of FIG. 3.
Figure 2:
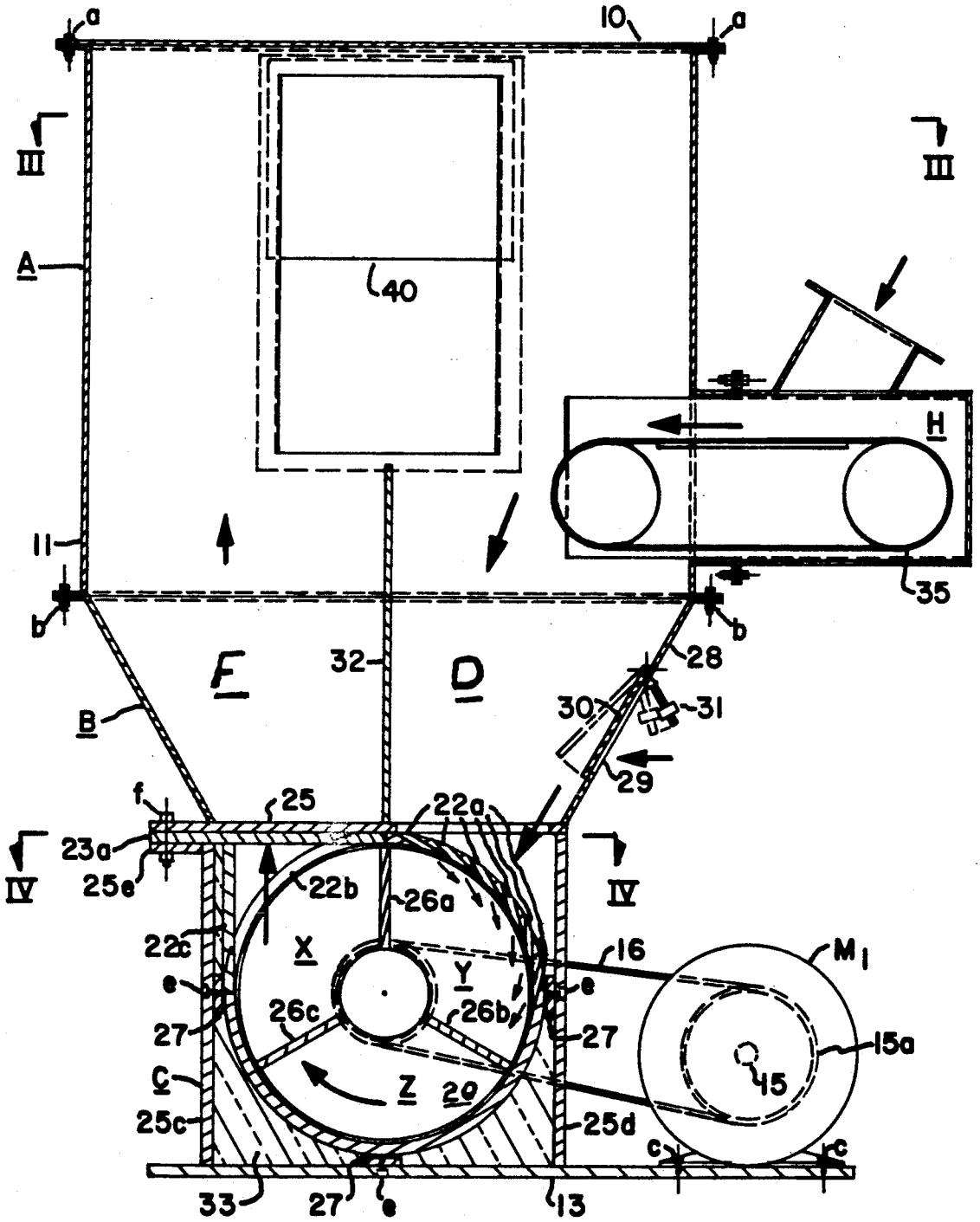
FIG. 2 is a vertical section on the scale of and taken at right angles to FIG. 1 and along the line II—II of FIG. 3.
Figure 3:
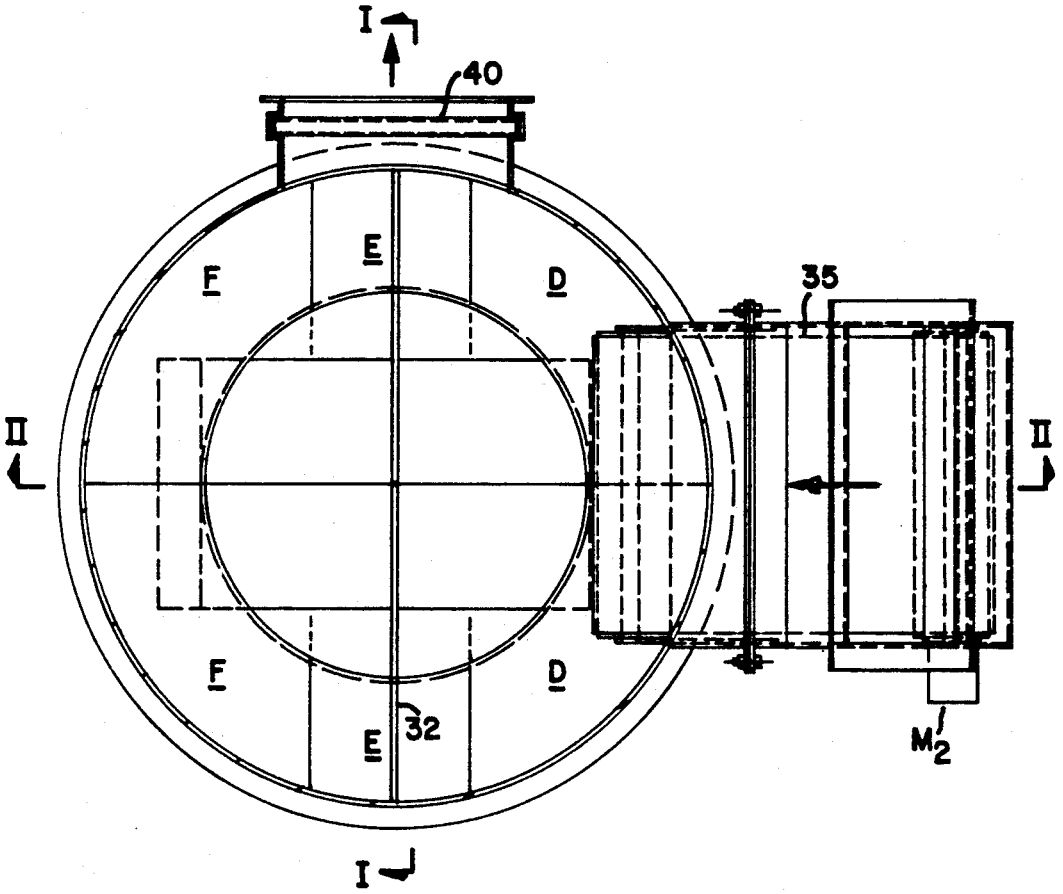
FIG. 3 is a horizontal section on the scale of and taken along the line III—III of FIG. 2 of the apparatus with its top cover removed.

Referring to FIGS. 1, 2, and 3, I have shown a device or apparatus provided with a round or cylindrical container having an upper chamber defining wall part A, an intermediate enclosing, cone-shaped, divided wall part B, and a lower housing part C for a motor-driven impeller or rotor 20. As shown in FIGS. 1 and 2, the upper part A has a closure lid 10 secured by bolts (a) to a cylindrical side wall 11 that is removably mounted by bolts (b) on an upper flange of the intermediate enclosure B that, at its lower end, carries the part C. As shown in FIGS. 2 and 5, an electric motor $M_1$, is removably mounted by bolts (c) on a base plate 13 and has a drive pulley 15*a* secured on its shaft 15 for actuating or rotating one hollow drive shaft end or collar 18*b* of the impeller or rotor 20 (see FIGS. 1, 2 and 5) through the agency of a belt 16 and a driven pulley 17. As shown in FIG. 1, another shaft end portion 18*a* of the rotor 20 is journaled within a bearing assembly 19*a* that is carried by a stationary adjacent bearing housing 24*a* that is bolted to an end wall 25*a* of an enclosing stationary, rectangular, outer housing 25 within which a cylindrical stationary housing 22 is mounted, using shims 27 and bolts (e). The impeller or rotor 20 is adapted to rotate within a substantially cylindrical inner housing 22 (see FIG. 1). Opposite end shaft portion 18*b* of the impeller or rotor 20 is journaled by a bearing assembly 19*b* within an opposite bearing housing 24*b* that is bolted to stationary end wall 25*b*.

Referring to FIGS. 1, 2 and 5, the impeller 20 is shown constructed of at least two (three are shown) opposed, parallel, axially spaced-apart circular discs 21*a* and 21*b* and intermediate disc 21*c* that are connected by longitudinally extending radial ribs or partitions 26*a*, 26*b* and 26*c*. The ribs are secured and connected to and extend between the journaled end collar or shaft parts 18*a* and 18*b* of the rotor 20, see also FIG. 5. A stationary cylindrical housing 22 in which the impeller 20 rotates has a series of elongated, backwardly sloped and slotted holes or portions 22*a* (see FIGS. 2 and 5) through its wall in the area below an air inlet flap valve 30 in an air inflow window or open portion 29 of a funnel-shaped side wall 28 of the intermediate housing B. The valve 30 is shown in FIG. 2 as pivotally mounted on the wall 28 and having a threaded stem and counter weight assembly 31 to allow adjusting the size of the air-inflow opening automatically, depending on impeller induced suction force controlled by the speed of the rotor 20. It will be noted that the air holes 22*a* (FIG. 2) are sloped in the direction of clockwise rotation of the impeller or rotor 20, see the arrows of FIG. 2.

The rotor or impeller 20, as particularly shown in FIGS. 1, 2 and 5, consists of the pair of opposite end, collar-like mounting shaft portions 18*a* and 18*b*, a group of axially-open, compartment-defining disc end walls 21*a* and 21*b* and intermediate disc wall 21*c*. Stationary, longitudinally endwise-extending compartment defining outer, drum-shaped or, cylindrical enclosing wall 22 has, as shown in FIG. 2, a series of the transversely extending air intake slots 22*a* and, in the direction of rotation of the impeller 20, a fully open out-flow window portion 22*b*, bounded by wall 22*c*, through which the ore bodies are projected upwardly-outwardly from each compartment defined by rib members 26*a*, 26*b* and 26*c*, radially under centrifugal force against a pair of endwise-aligned abutment pieces or anvils 23*a* and 23*b*. The anvils 23*a* and 23*b* are shown removably mounted by bolt and nut assemblies (f) on a bottom closure member 25*e* of an outflow-chamber half F of the intermediate enclosure B of the container.

Radial ribs 26*a*, 26*b* and 26*c* not only provide cross connecting partitions in the rotor 20, but also define its radially open compartments X, Y and Z, see FIG. 2. It will be noted that a central partition 32 divides intermediate part of the container into two chambers D and F. The arrows of FIG. 2 show input chamber D for the air and the upper flow output and selection chamber F for the broken-up material. As shown by the arrows in FIG. 2 and 5, broken-up lighter bodies of smaller size move horizontally endwise out and upwardly under air fluidization from opposite ends of the anvils 23*a* and 23*b*. Rejected heavier and thus, larger bodies, fall immediately to return downwardly into the compartments X, Y and Z of the impeller 20 therein and are then mixed with ore bodies being newly introduced into both hollow end shaft parts 18*a* and 18*b* of the impeller 20.

The fluidized bodies of, for example, particle to particulate sizes and thus, of a relatively wide range of smaller sizes are flowed transversely outwardly from both ends of the anvil (FIG. 5) and then upwardly while still under air fluidization. They are then subjected to a second and final stage of classification or selection, as effected in upper enclosed chamber area A of the apparatus. That is, they are then subjected to a further and controlled fluidization, such that bodies, such as particulates of the desired size, are only flowed out of the apparatus, and all those that are of a rejected larger or particle size and greater weight fall backwardly downwardly into the compartments of the rotating impeller 20 to combine with newly entering ore bodies for reprocessing or recycling with them. The amount of breakage is controlled by the effective speed of rotation of the impeller, as controlled by changing the speed of the motor $M_1$ by the use of a rheostat. By way of example, I have found that, for an ore body such as bituminous coal, a rate of about 3000 to plus or minus 3500 r.p.m. with 12 inch diameter discs is satisfactory. By, as shown, upwardly increasing the cross-section or size of the outflow chamber, see FIG. 2, such that fluidization decreases upwardly, I have been able to cause the larger size particles to fall backwardly and group to return back into the rotor or impeller 20 for reprocessing with ore bodies being newly introduced.

In FIG. 2, ore bodies to be broken up are, see the arrows, introduced through a sloped entry into a closed end feed chamber H onto a belt conveyor 35 driven by motor $M_2$ to enter the side of chamber A, dropping into feed chambers D of intermediate chamber B and under controlled fluidization by air entering through valve 30, enter opposite end chambers E (see FIG. 1) and then, under air fluidization, enter opposite open shaft ends and the compartments X, Y and Z of the impeller 20. The assembly represented by H in FIG. 2 is designed to introduce the ore bodies into the chamber E of wall B of FIG. 1 while substantially restricting air in-flow to the impeller 20. The bodies are primarily fluidized by air being controlled and introduced through valve 30 and flowed, as shown in FIGS. 1 and 2, downwardly through slotted and sloped holes 22*a* tangentially through cylindrical housing 22.

Referring to FIG. 1 and 2, finally sized particulates that are being continuously provided and flowed upwardly into a large upper expansion chamber A are discharged into a suitable dust collector (not shown) through a pressure-sensitive expansion valve 40.

It will be noted that, as the volume of air decreases as the broken particles rise through spacing of increasing size, particles of gradually decreasing size fall backward to return to the rotor impeller, until in the top enlarged air chamber of the apparatus, particulates of a minimum size range represent the yield which has been obtained from the feed charge of the ore bodies.

The discs 21*a* and 21*b* and 21*c* define the radially open outer portions of the impeller 20, while their centrally open ribs 26*a*, 26*b* and 26*c* define the open axis of the impeller and, as shown in FIG. 5, are in open alignment with the feed-in openings in the end shaft parts 18*a* and 18*b*. As shown in FIG. 2, I provide a surrounding housing 22 for rotation of the impeller 20 that is substantially circular in shape, except that it has a window defining planar portion 22*b* at its upper left hand chamber area for permitting a centrifugally accelerated power projection of the ore bodies from the impeller 20 against the anvils 23*a* and 23*b* (see FIG. 5). The circular shaped housing part 22 may be of a suitable abrasion-resisting metal that serves as a bearing wall about the impeller 20 and is mounted within a resilient, sound and shock-absorbing backing 33 of a resin or plastic material, such as urethane. I also show spacer shims 27 at three spaced locations to, as inserts, mount cylindrical inner housing 22 in the outer housing enclosure 25 using bolts (e). It will be noted that the resilient material 33 (see FIG. 2) also extends as a packing between the side wall 25*c* and planar extension metal piece 22*c* of the housing part 25 adjacent the outflow or ore body projection window portion 22*b*.

What is claimed is:

1. In a machine for pulverizing ore bodies and the like, a housing having a lower housing enclosure having an outflow passageway, a rotating impeller operatively mounted within said housing enclosure, means for driving said impeller, said impeller having at least a pair of axially extending radially divided ore body carrying compartments, a hollow shaft means mounting said impeller for rotative movement within said housing enclosure, means for feeding ore bodies into opposite ends of said shaft means, said shaft means extending axially to and being open to said compartments for delivering the ore bodies therein during rotation of said impeller, anvil means positioned within said outflow passageway of said enclosure, wherein said means for driving said impeller develops centrifugal force to progressively project ore bodies in said compartments radially outwardly therefrom against said anvil to break them up as thus projected, means for progressively introducing a fluidizing gas such as air into each of said compartments to fluidize the ore bodies therein and, after the ore bodies have been broken-up, to carry broken-up particles of a desired smaller size upwardly within and out of said housing enclosure while broken-up bodies of an undesired larger size to fall back and re-enter said compartments to combine with additional ore bodies being introduced therein and fluidized for repeating the breaking-up operation.

2. A machine as defined in claim 1 wherein said feeding means includes means to feed ore bodies downwardly and then horizontally into opposite ends of said hollow shaft means under fluid pressure.

3. A machine as defined in claim 1 wherein said shaft means has a pair of open end collars, and said compartments are defined by axially extending spaced-apart ribs and axially spaced-apart radial discs connected to said ribs and said end collars.

4. A machine as defined in claim 1 wherein the machine has an upwardly converging triangular-shaped inner enclosure that at its lower end substantially encloses an upper half portion of said impeller, and valve means for introducing fluidizing air within said inner enclosure and from said inner enclosure into each of said compartments of said impeller during a portion of its rotative movement.

5. An impaction apparatus for breaking up ore bodies and the like which comprises, a housing enclosure, a rotating impeller operatively mounted within said enclosure, said impeller having at least a pair of compartments separated by at least a pair of radial partitions hollow shaft means rotatably carrying said impeller, means for feeding ore bodies through said shaft means into said impeller compartments, a drive means operatively connected to said shaft means for rotatably driving said impeller, a bearing-wall about said impeller, said wall having a fluidizing gas entry portion that is open to each of said compartments in succession during rotation of said impeller anvil means mounted in said enclosure adjacent said impeller, said bearing wall having a portion therein that is open to the other of said compartments when the first-mentioned compartment is receiving fluidizing gas during rotative advancing movement of said impeller, said impeller being adapted during its rotative movement to successively fluidize ore bodies within said compartments and then project them outwardly under centrifugal force against said anvil means to break them up and, under fluidization, separate and remove fragmented particles of a desired size from said enclosure while returning ore bodies of larger than the desired size into said impeller for recycling them with newly introduced ore bodies during impeller rotative operation of the apparatus.

6. A method of breaking-up frangible ore bodies which comprises, feeding the bodies endwise into a hollow-shaft means of a rotating impeller, progressively advancing the bodies from the shaft means into axially extending radially divided compartments of the impeller, progressively introducing a fluid such as air into the compartment and fluidizing the ore bodies therein, rotating the impeller to develop a centrifugal force within the compartments of the impeller, progressively projecting the fluidized bodies radially outwardly from the compartments into a breaking-up impaction against an anvil, separating desired smaller size particles of the broken-up bodies from larger sizes, moving the desired size particles upwardly outwardly from and about the anvil, and collecting and returning the larger size particles to the compartments of the rotating impeller and therein combining them with newly supplied ore bodies and repeating the operation.

7. A method of breaking-up ore bodies into a desired size of particles or particulates within an apparatus employing a motor-driven rotating impeller having a hollow shaft means for introducing the bodies into a centrifugal force generating impeller which comprises, introducing the ore bodies axially into opposite ends of the hollow shaft means and then radially into compartments of the impeller while progressively radially introducing a fluid such as air therein and progressively fluidizing the bore bodies therein, periodically and progressively projecting the fluidized ore bodies radially outwardly from the compartments of the impeller under centrifugal force against an anvil and thereby impaction breaking them up, advancing broken up particles of a desired selected size of the ore bodies under fluidization upwardly around the anvil and out of the apparatus while fluidization upwardly around the anvil and out of the apparatus while returning a rejected portion of the ore bodies of larger than the desired size to the impeller and, under rotation of the impeller, thereafter introducing additional fluid and ore bodies therein and combining them with the rejected portion of the ore bodies, and repeating the procedure until a desired quantity of the selected size particles has been obtained.

8. A method of breaking-up frangible ore bodies which comprises, feeding the bodies endwise within a hollow-shaft means of a rotating impeller, progressively advancing the bodies from the shaft means into axially extending radially divided compartments of the impeller, progressively introducing a fluid such as air peripherally into the compartments and then progressively fluidizing the ore bodies therein, rotating the impeller to develop an outward centrifugal force within the compartments of the impeller and projecting the fluidized bodies radially outwardly there from into braking-up impaction against an anvil, separating desired smaller size particles of the broken-up bodies from larger sizes, delivering desired smaller size particles under fluid flotation upwardly outwardly from the impeller, and collecting rejected larger size particles within the compartments of the rotating impeller and combining them with newly supplied ore bodies and repeating the operation.

9. A method as defined in claim 8 wherein the rotating impeller has three radially-divided compartments into which the ore bodies are introduced from the hollow shaft, and fluidizing air is sucked-into each compartment in succession while the ore bodies are being impelled outwardly under centrifugal force in succession from each compartment into breaking-up impaction against the anvil.

10. A method as defined in claim 8 which further comprises resiliently cradling the impeller during its rotation.

11. A method as defined in claim 8 wherein the amount of air introduced is valve-controlled.

* * * * *